United States Patent [19]

King

[11] Patent Number: 4,728,101

[45] Date of Patent: Mar. 1, 1988

[54] PNEUMATIC EXERCISING DEVICE

[76] Inventor: David M. King, 21088 Pitts Rd., Wellington, Ohio 44090

[21] Appl. No.: 34,660

[22] Filed: Apr. 6, 1987

[51] Int. Cl.[4] ..... A63B 21/00

[52] U.S. Cl. ..... 272/130; 272/143

[58] Field of Search ..... 272/117, 118, 129–131, 272/134, 143, 144

[56] References Cited

U.S. PATENT DOCUMENTS

| | | | |
|---|---|---|---|
| 4,241,913 | 12/1980 | Zwayer et al. | 272/130 |
| 4,257,593 | 3/1981 | Keiser | 272/130 |
| 4,354,676 | 10/1982 | Ariel | 272/129 |
| 4,397,462 | 8/1983 | Wilmarth | 272/130 |
| 4,542,899 | 9/1985 | Hendricks | 272/118 |
| 4,624,457 | 11/1986 | Silberman et al. | 272/118 |
| 4,645,205 | 2/1987 | Wolf | 272/143 |

*Primary Examiner*—Richard J. Apley
*Assistant Examiner*—J. Welsh
*Attorney, Agent, or Firm*—Gustalo Nunez

[57] ABSTRACT

A pneumatic exercising device for the development of muscles, the maintenance of muscle tone, and for the medical rehabilitation of muscles affecting the movement of a person's limbs and the like, comprising a vertically rising frame member including two air pressure controlled work stations, each work station being adapted for multiple exercises, a source of compressed air, and a plurality of members extending outwardly from the vertically rising member. The exerciser works against a constant pressure applied to a pneumatic cylinder and depending on the exercise, is either pulling or pushing against the cylinder. The exercising machine is designed to allow a person to do a plurality of workouts on one machine. Some of the workouts that can be done with this exercising machine are bench, incline bench, decline bench, military press, squats, leg press, leg extension, leg curls, dead lift, shrugs, pullups, arm curls, lat pulldowns, and incline sit ups.

1 Claim, 4 Drawing Figures

PNEUMATIC EXERCISING DEVICE

BACKGROUND OF THE INVENTION

1. Field of the Invention

The present invention relates to a pneumatic exercising device which utilizes compressed air which allows the user to do positive exercising or negative exercising. The exercising device described herein is a compact device, i.e., one exerciser with multiple work stations, and therefore capable of being used for a variety of exercises.

2. Description of the Prior Art

There appears to be a multiplicity of exercising devices, which employ dead weight, pressurized hydraulic fluids or compressed air for providing the resistance required in exercising. The prior art depicts exercising machines which may be used for limited exercises only and therefor, by necessity, would require a multiplicity of exercise machines. They do not possess the characteristic of permitting the great variety of exercises that those who are devotees of body building require for simplicity and economy.

One example of such a machine employing pressurized air is U.S. Pat. No. 4,397,462 issued to Wilmarth. This particular device is severely limited in what kind of exercises may be performed with said device. Similarly, the exercising device disclosed in U.S. Pat. No. 4,257,593, issued to Keiser, also used a compressed gas for providing the resistance needed for the exerciser. With this particular exerciser, again, the number of exercises which can be performed are severely limited.

SUMMARY OF THE INVENTION

The present invention is a pneumatic exercising machine which was developed particularly for the individual home workout, but which could also be used in gyms or the like. The instant machine utilizes a two way air cylinder. Air is compressed by a conventional type air compressor and is transported to a storage tank via pneumatic lines. The amount of weight or resistance desired by the exerciser is controlled by a regulator. There are a multitude of exercises that may be performed with this exercising machine; for example, bench press, incline bench press, decline bench press, military press, squates, leg press, leg extension, leg curls, dead lift, shrugs, pullups, arm curls, lat pulldowns and incline situps. This exercising machine is excellent for developing the following: trapezius, posterior deltoids, latissimus dorsi, hips, back quadriceps, gastocnemius, pectorals, upper abdominals, lower abdominals, front quadriceps, anterior deltoid, triceps, biceps and the anterior serratus.

The exercising machine may also be used in negative lifting which is the situation where there is an extreme amount of weight on the machine such that the exerciser cannot lift it on his own, but where the exercising machine can bring down slowly. The exercising machine herein to be described is designed to lift the weight for the person who then pulls it down which, as mentioned above, is negative lifting.

Throughout the entire country, spas, health resorts, gymnasiums and exercise clubs are springing up to the extent that they form an important part of our society. People are involved in jogging, calisthenics, walking, bike riding, swimming, and the list goes on. These are all fine forms of exercise but are not directed to give the person involved the results given by the applicant's exercise machine. People now want well-shaped, hard bodies which requires one to exercise with weights or resistance type exercisers. The instant invention is versatile to the extent that it can be used to develop the entire body. Because of the type of resistance system used here, the user is given an exercise device which can be set at any number of values and is mechanically simple and economical to manufacture. Also, the present exercising machine provides the user with a machine in which the "weights", i.e., the force which the user wants to overcome, can be easily adjusted and varied simply by the twist of an air regulator. This exercising machine eliminates the necessity of removing and/or adding weights. It is compact in design, does not require excessive room and floor strength is not a prerequisite as it is with the typical weight machines which utilize weights. The force applied by the present exercising machine is constant throughout the range of motion thereby requiring the user to apply maximum effort in overcoming the force exerted by the machine. Also, because of the range of pressures which can be arrived at by the air regulator, the present machine gives the user an infinite range of simulated weights.

DESCRIPTION OF THE PREFERRED EMBODIMENT

Figure 1:
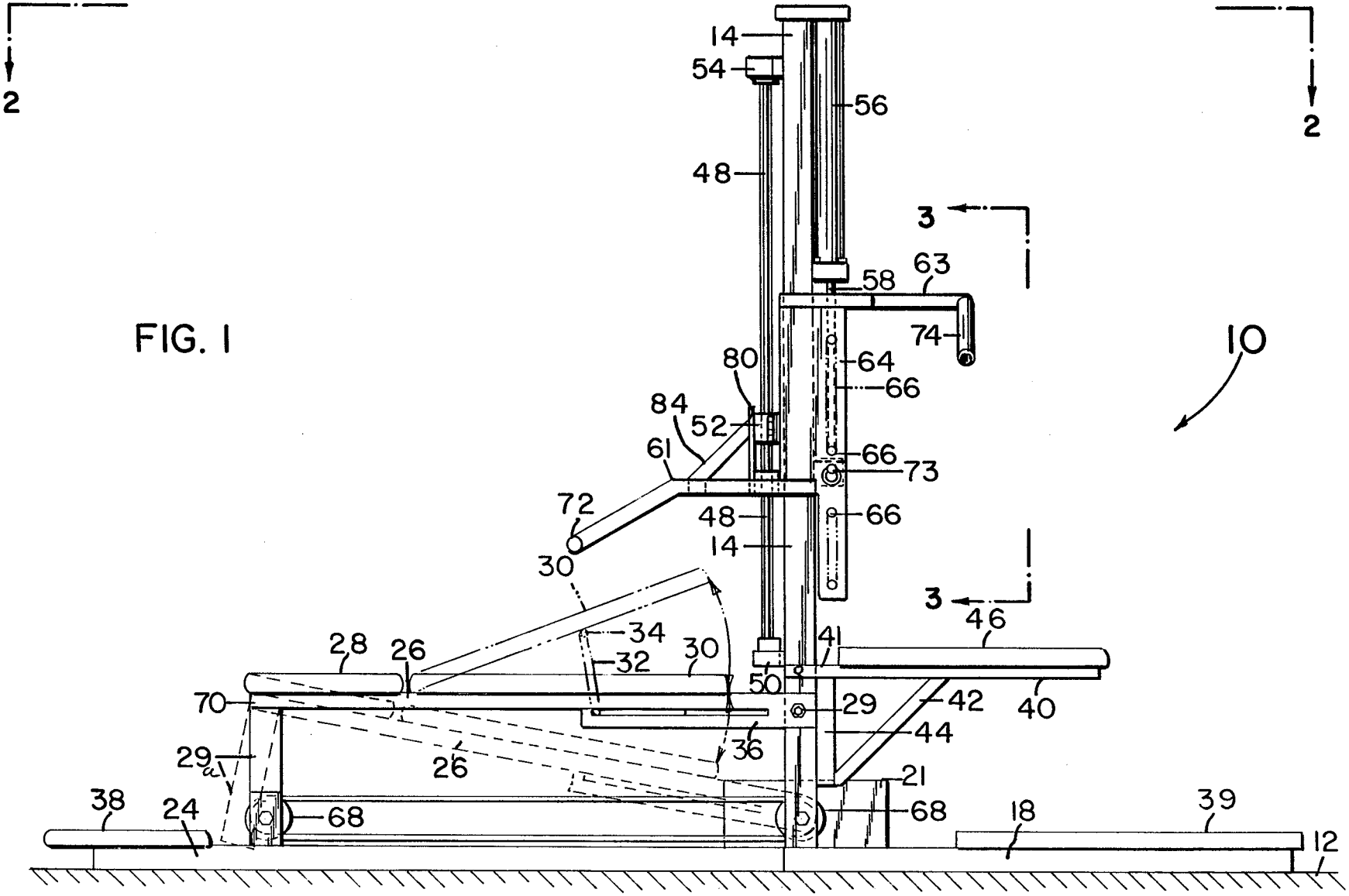
FIG. 1 is a partial fragmentary side view of the exercising device.
Figure 2:
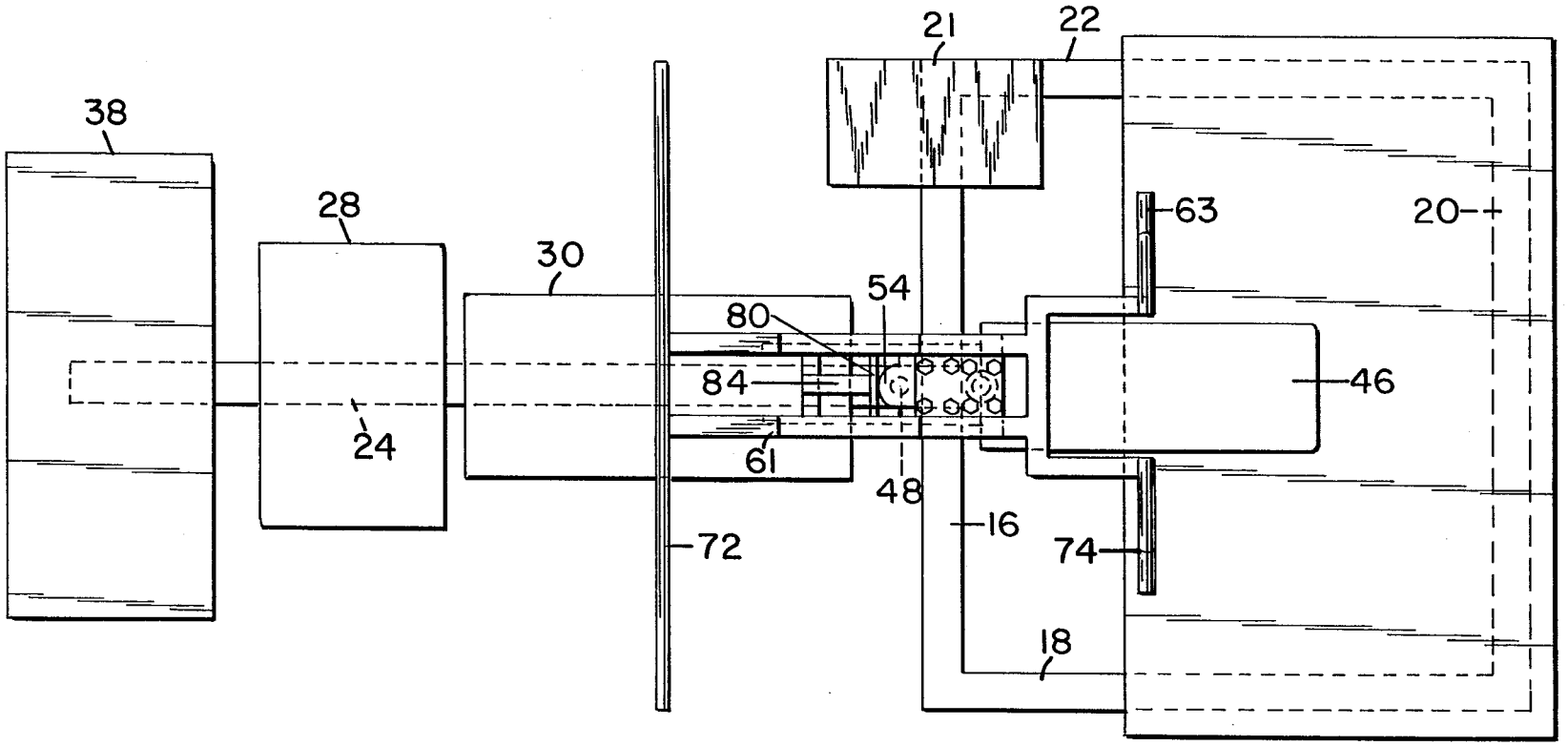
FIG. 2 is a top view of the exercising device taken along lines 2—2.

Referring more particularly to the drawings, the pneumatic exercising device of the present invention is generally indicated by the numeral 10 of FIG. 1. The exercising device 10 is shown supported by a floor 12. The device 10 as shown in FIG. 1, has a main support member 14. The main support member 14 is connected to a floor support leg member 16 by conventional means such as welding. The leg member 16 is bisected by the main support member 14 and is in a plane perpendicular to the support member 14. The leg member 16 is connected to leg support member 18, 20, 22 which when viewed from above (FIG. 2), the leg members 16, 18, 20 and 22 form a rectangle. Leg support member 16 is further connected to an extending floor support member 24 and is positioned such that floor support member is perpendicular to leg member 16. The leg support members 16, 18, 20, 22 and 24 are fabricated from substantially rectangular-shaped tubular beams. When assembled the leg support members form a chamber for the storage of pressurized air, reasons for which will soon be hereafter given. An air compressor device is shown at 21 as a black box, since these are well known devices and are considered to be shelf items.

Again referring to FIG. 1, a bench member 26 is shown removably connected to the main support member 14 by conventional connecting means such as a wing bolt or cotter pin at 29. Bench leg member **29*a* supports the bench member 26. This enables the easy removal of the bench member 26, if desired. The bench 26 is further equipped with platform cushions 28 and 30. Platform bench 30** is rotatably adjustable by raising the end closet to the main support member 14. A linking support member 32 is pivotally connected to platform cushion30 at 34. The other end of linking support member 32 is movably connected to a bearing member 36. Bearing member 36 may be furnished with a plurality of undulations or with a plurality of holes for holding the linking member 32 in a fixed position. The platform cushion is better supported with the use of a pair of linking members 32, by placing a linking member 32 on each side of the platform cushions 30. The bench 26 is shown to be in a disconnected position, in FIG. 1, by the dashed lines. The pneumatic exercising device 10 is also equipped with a foot rest 38 which is connected to the floor support member 24 and is also equipped with a foot rest 39 at an end opposing the end supporting the foot rest 38.

Also removably connected to the main support member 14 is a bench 40. It is connected at 41 by conventional pins such as a cotter pin. The bench 40 is further reinforced by connecting members 42 and 44. As can be seen, connecting member 44 rests against the main support member 14. The benches 26 and 40 are diametrically opposed to each other. Bench 40 is also equipped with a platform cushion 46.

An elongated rod member 48 is shown in a parallel relationship with main support member 14 and connected to the main support member 14 by collars 50, 52 and 54. The collars 50, 52 and 54 may be welded by conventional means to the main support member 14.

Affixed to the upper portion of the main support member 14 is a pneumatic cylinder 56 with a cylindrical plunger 58 pointed in a downward direction. The exercise device 10 incorporates the use of an air compressor to supply pressurized air to the air chamber formed by the support legs 16, 18, 20, 22 and 24. A conventional hose fitting is mounted to the air chamber for connecting to an air hose. The air hose is inserted into the hollow chamber contained in the upright support member 14. An opening may be provided in the upper portion of support member 14 by which the air hose may be connected to the pneumatic cylinder 56. The air connections and air supply have not been shown in the drawings inasmuch as they constitute conventional items and their details would not add to the description of the present invention. Also, the means by which the air regulator can be adjusted are not shown, for the same reasons.

Figure 3:
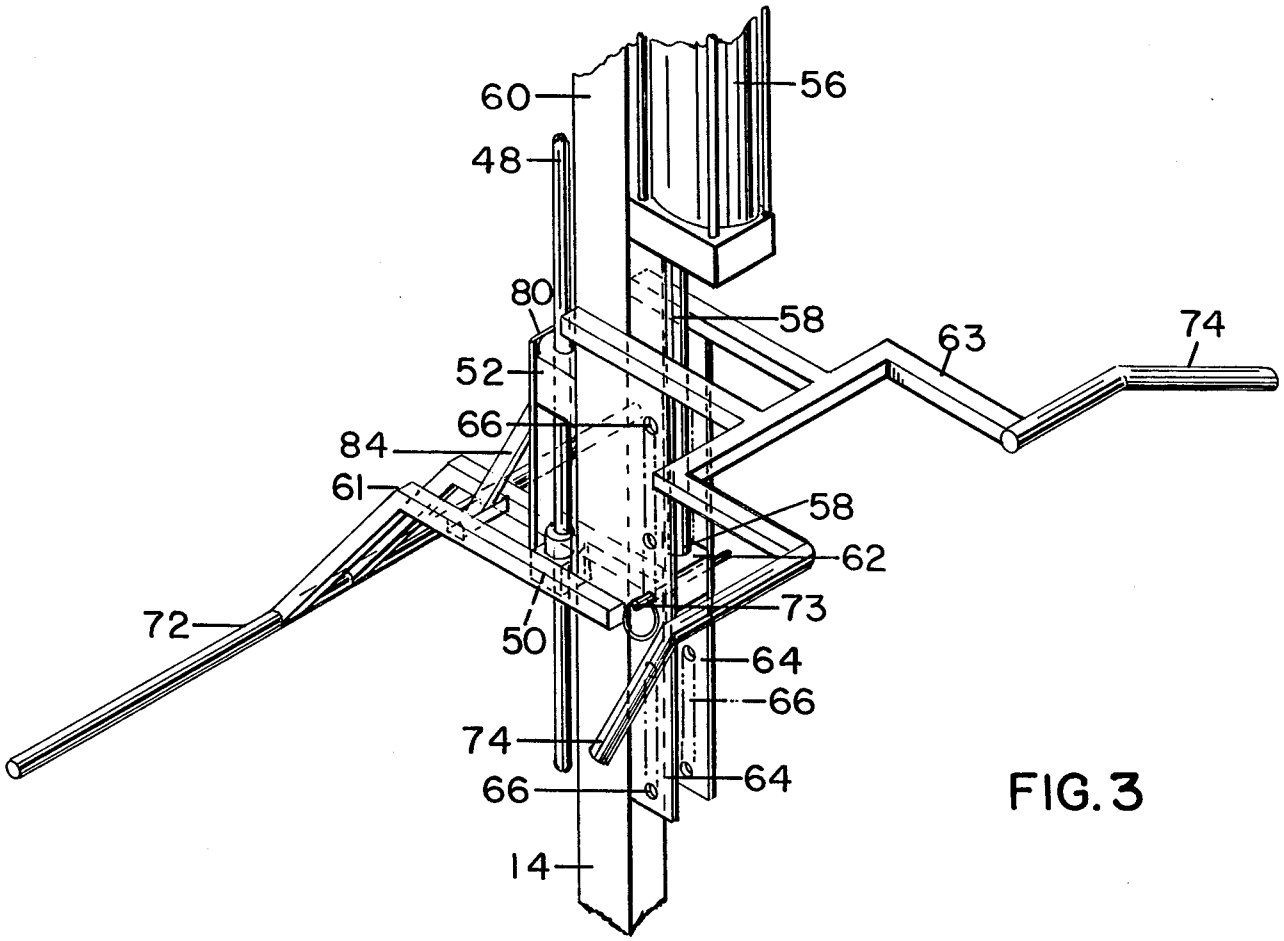
FIG. 3 is a partial perspective view of the exercising device taken along lines 3—3.
Figure 4:
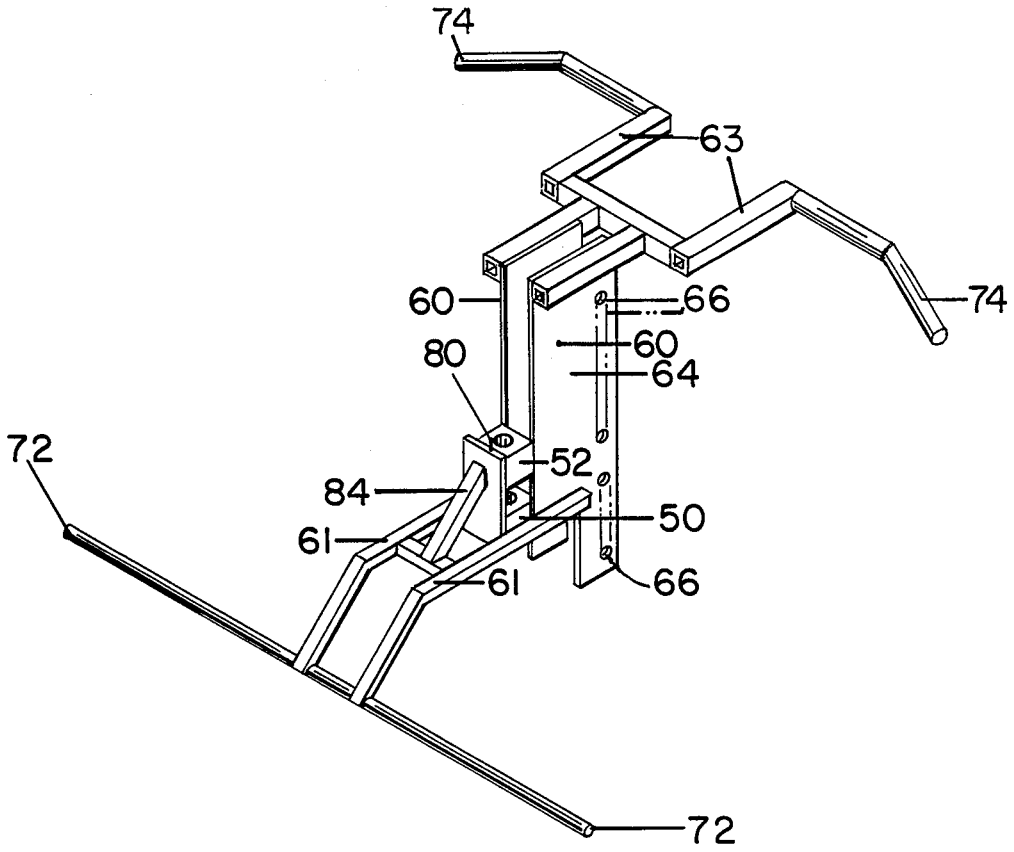
FIG. 4 is a partial perspective view of the telescopically slideable handle bar assembly.

Referring now to FIG. 3, there can be seen a pair of opposing handle bar assemblies 61 and 63 slideably affixed to the main support member 14. The handle bar assembly is reinforced, because of its extending length, by a diagonal member 84 which is conventionally connected to a flat member 80 to the collar 52. The hand bar assemblies are connected to a rectangular member 60 which is open in the center thus allowing the rectangular member 60 to be telescopically connected to the main support member 14. The plunger 58 is connected to the rectangular member 60 at 62 by conventional bolting means. The bar 48 serves as a guide for the handle bar assemblies 61 and 63 as they are moved up or down. The bar 48 and frame member 14 both serve as guide members and also provide stability to the handle bar assemblies 61 and 63 when being used in the exercise mode.

The rectangular assembly 60 is furnished with a pair of parallel extending members 64 which have thereon a plurality of apertures 66 which are used to hold the rectangular member at the height desired by the user, depending on which exercises are being used. Again, this is accomplished by well-known connecting means such as cotter pins at 73.

Again referring to FIG. 1, there is shown at the lower portion thereof a pulley cable arrangement 68 which is used by attaching a leg curl exercise unit at 70 (not shown) by conventional methods.

The pneumatic cylinder receives pressurized air via an air hose which is enclosed within the main support member 14. The pressurized air supply, as was mentioned previously, is contained in the air chamber formed by the leg member 16, 18, 20, 22 and 24.

The present exerciser 10 was developed for the individual home work out, but it can also be used in commercial health spas. The exerciser 10 is operated by a two way conventional air cylinder. Air is pumped into the air chamber described above. A conventional air compressor can be used. The air when used to operate the cylinder 56 is controlled by a conventional air regulator which sets the amount of weight (air pressure) which the user desires and which also controls whether the plunger 58 will be going up or down. The air regulator keeps the resistance constant as the user is using the exerciser 10. The exerciser 10 is designed such that many different types of exercises may be accomplished, eg. bench, incline bench press, decline dead lift, military press, squats, leg press, leg extension, leg curls, dead lifts, shrugs, pull ups, arm curls, lat pull downs, and incline situps.

An example of use will be illustrated. In the bench press, the user would lay his back on the bench 26. The height of the handle bar assembly 61 and the air pressure (resistance desired) would be set beforehand. The plunger 58 would be biased by air pressure in a downward position. The user would place his hand around the hand bars 72. The user would push the hand bars 72 in an upward direction, when the force exerted by the user exceeds the resistance applied by the plunger 58, the handle bars 72 will then move in a upward direction. At the time the user's arms are in a completely extended position, the user would then bring the handle bars 72 back to the original starting position. Similarly, if the user wanted to do a military press, he would elevate the handle bar assembly 63 to the desired height, set the air regulator control, stand under the handle bar assembly 63 with his back to the handle bar assembly 63. He would grip the handle bars 74 and push upwardly until the force exerted by the user exceeds the resistance of the plunger 58, at which time the handle bar assembly 63 will move upwardly.

While the form of the exercising device herein described constitutes a preferred embodiment of the invention, it is to be understood that the invention is not limited to this precise form of apparatus, and that changes may be made therein without departing from the scope of the invention defined in the appended claims.

What is claimed is:

1. A pneumatic exercising device for providing a plurality of body exercises, comprising:

an upright tubular frame member, leg support members secured to said upright tubular frame member, said leg support members forming an air chamber for the containment of a pressurized fluid, means for providing pressurized fluid to said air chamber, a handle bar means mounted coaxially around said upright tubular member so as to slide up and down said member, said handle bar means including two handle bar assemblies disposed on opposite sides of said upright member, a two way pneumatic device connected adjacent the upper portions of said tubular upright member, said two way pneumatic device including a plunger generally parallel to a longitudinal axis of said upright tubular frame member, said plunger secured to said handle bar means, said two way pneumatic device including means for regulating the direction of resistance of said plunger, means for adjusting the distance of said handle bar means along said upright member from said plunger, and a plurality of adjustable support means connected to said upright tubular frame member below said handle bar means for supporting a human body when engagement is made with said handle bar assemblies, said handle bar assemblies resisting motion in a direction set forth by said means for regulating said two way device.

* * * * *